US006865997B2

(12) United States Patent
Stephens

(10) Patent No.: US 6,865,997 B2
(45) Date of Patent: Mar. 15, 2005

(54) APPARATUS FOR MANEUVERING BOATS

(75) Inventor: James Michael Stephens, 408 Hidden Hills Dr., Greenville, SC (US) 29605

(73) Assignee: James Michael Stephens, Greenville, SC (US)

( * ) Notice: Subject to any disclaimer, the term of this patent is extended or adjusted under 35 U.S.C. 154(b) by 0 days.

(21) Appl. No.: 10/705,710

(22) Filed: Nov. 11, 2003

(65) Prior Publication Data

US 2004/0094081 A1 May 20, 2004

Related U.S. Application Data

(63) Continuation of application No. 10/189,051, filed on Jul. 2, 2002, now Pat. No. 6,655,309.

(51) Int. Cl.[7] ..... B63H 25/46

(52) U.S. Cl. ..... 114/144 A; 114/144 E; 114/151; 440/6

(58) Field of Search ..... 114/144 A, 144 RE, 114/144 E, 151; 440/6, 7; 446/154

(56) References Cited

U.S. PATENT DOCUMENTS 3,280,501 A * 10/1966 Hornbostel ..... 446/154
3,593,686 A 7/1971 Cooper et al.
3,689,927 A * 9/1972 Boston et al. ..... 213/3
3,980,039 A 9/1976 Henning
4,614,900 A * 9/1986 Young ..... 318/16
4,747,359 A 5/1988 Ueno
5,140,926 A * 8/1992 Denston ..... 114/150
5,832,440 A 11/1998 Woodbridge et al.
6,273,771 B1 8/2001 Buckley et al.
6,308,651 B2 10/2001 McKenney et al.
6,357,375 B1 3/2002 Ellis
6,655,309 B1 * 12/2003 Stephens ..... 114/144 A

OTHER PUBLICATIONS

"On The Docks", *Yachting*, Aug. 2003, p. 84.
"News and Notes", *PASSAGEMAKERS*, Jul./Aug. 2003, p. 35.
"Bow Thrusters" 2 pages.

* cited by examiner

*Primary Examiner*—Sherman Basinger
(74) *Attorney, Agent, or Firm*—Dority & Manning, P.A.

(57) ABSTRACT

An apparatus for aiding in steering and maneuvering a boat that includes a thruster that applies a force transverse to the longitudinal axis of the boat. The operation of the thruster is under control of a remote radio frequency transmitter which permits an operator of the boat to operate the thrusters without being on the bridge of the boat. A switching circuit that includes relays and solenoids associated with a solenoid valve operates with the remote frequency transmitter and receiver to energize a thruster on the boat.

3 Claims, 3 Drawing Sheets

APPARATUS FOR MANEUVERING BOATS

RELATED APPLICATION

The present application is a Continuation Application of U.S. Ser. No. 10/189,051 filed on Jul. 2, 2002 now U.S. Pat. No. 6,655,309.

BACKGROUND OF THE INVENTION

The present invention relates to an apparatus for aiding in maneuvering and steering a boat, and more particularly to an apparatus for remotely maneuvering a boat.

Heretofor large boats, often referred to as houseboats, when traveling on open water tend to drift off course and as a result of the size of the boat, it requires some skill in maneuvering the throttles and/or steering wheel of the boat to bring it back on course. This also requires the operator of the boat to be located at the steering wheel. Many times when cruising on large bodies of water, the houseboat is set to travel at a relatively slow speed in a particular set direction. Unfortunately as a result of wind and currents and because a houseboat normally does not have a deep keel, the boat tends to drift off its desired course of travel. This drift can be corrected by manipulating the steering wheel, the thrust of the engines, and on some boats by operating thrusters. The problem with all three of the above is that they require the operator of the boat to be located in the area of the steering wheel and controls.

SUMMARY OF THE INVENTION

Accordingly it is an object of the present invention to provide a simple and convenient apparatus for maneuvering a boat without requiring the operator to be on the bridge of the boat. The apparatus includes a thruster which is carried adjacent the stern or bow of the boat that is operated by supplying pressurized hydraulic fluid to a hydraulic motor. It is to be understood the other types of motors such as electric motors can be utilized for driving the thruster instead of a hydraulic motor. When a hydraulic motor is used, a hydraulic pump is energized for supplying the fluid to the motor. The operator by means of remote radio frequency transmitter can generate signals indicating the desired direction that he wants the thruster to be rotated. The signal generated by the radio frequency transmitter is received by a radio frequency receiver that is carried on the boat.

As a result of utilizing remote radio frequencies, it is not necessary for the operator of the boat to be on the bridge of the boat when energizing the thrusters to maneuver the boat. When utilizing a hydraulic motor, a solenoid operated valve is connected to the hydraulic pump and to the motor. A first solenoid is operably connected to the solenoid valve for controlling the flow of hydraulic fluid to the hydraulic motor to rotate the hydraulic motor in a first direction upon being energized. A second solenoid is operably connected to the solenoid valve for controlling the flow of hydraulic fluid to the hydraulic motor for rotating the hydraulic motor in a second direction upon being energized. An electrical switching circuit is connected to the radio frequency receiver and to the first and second solenoids for causing one of the solenoids to be energized upon being activated by a signal from the receiver. As a result, an operator of the boat can maneuver the boat with a remote radio frequency transmitter which is used for activating the thrusters provided on the boat.

In one particular embodiment, the electrical switching circuit includes a pair of relays, each of which has a bank of contact switches associated therewith. Upon energizing one of the relays by the remote control transmitter switches are closed for engaging a clutch associated with the hydraulic pump as well as energizing one of the solenoid valves associated with the hydraulic pump to cause the motors of the thrusters to be driven in one direction. When the other relay is energized by the remote control transmitter, it also causes the clutch associated with the hydraulic pump to be engaged. It sends a signal to the other solenoid associated with the solenoid valve for causing pressurized hydraulic fluid to be sent to the motors of the thruster for rotating the thruster in the opposite direction. While the drawings illustrate two hydraulic motors with the thruster in FIG. 2, it is to be understood that a single motor could be utilized instead of two.

Accordingly, it is an object of the present invention to provide a remote controlled apparatus for steering and maneuvering boats.

The above and other objects, features, and advantages of the present invention will become more apparent from the following detailed description in conjunction with the accompanying drawings.

DETAILED DESCRIPTION

Figure 1:
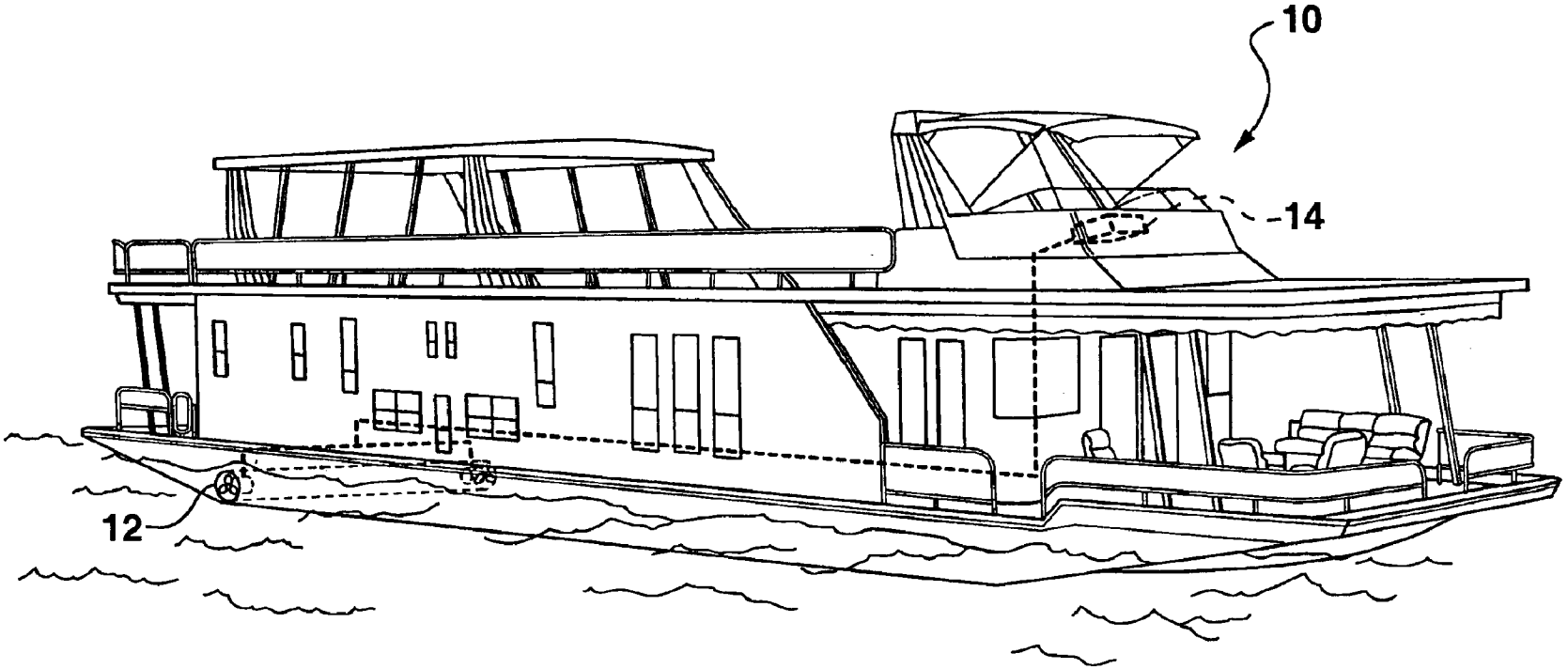
FIG. 1 is a perspective view of houseboat upon which an apparatus for maneuvering the boat can be mounted.

In FIG. 1 there is disclosed a houseboat 10 that is equipped with a thruster 12 provided adjacent the stern of the boat. Controls 14 for operating the thrusters are mounted on the bridge of the boat adjacent the steering wheel and throttles for the engines of the boat. Houseboats don't generally travel at high speeds, and as a result, wind and tides often cause the boat to deviate from its desired course. Such can be corrected by manipulating the throttles on the engines, or by the combination of steering and manipulation of the throttles. To bring the boat back to a stabilized exact direction requires some skill and attention. Such also requires the operator of the boat to be on the bridge at all times since the controls for the throttles are generally located there.

Figure 2:
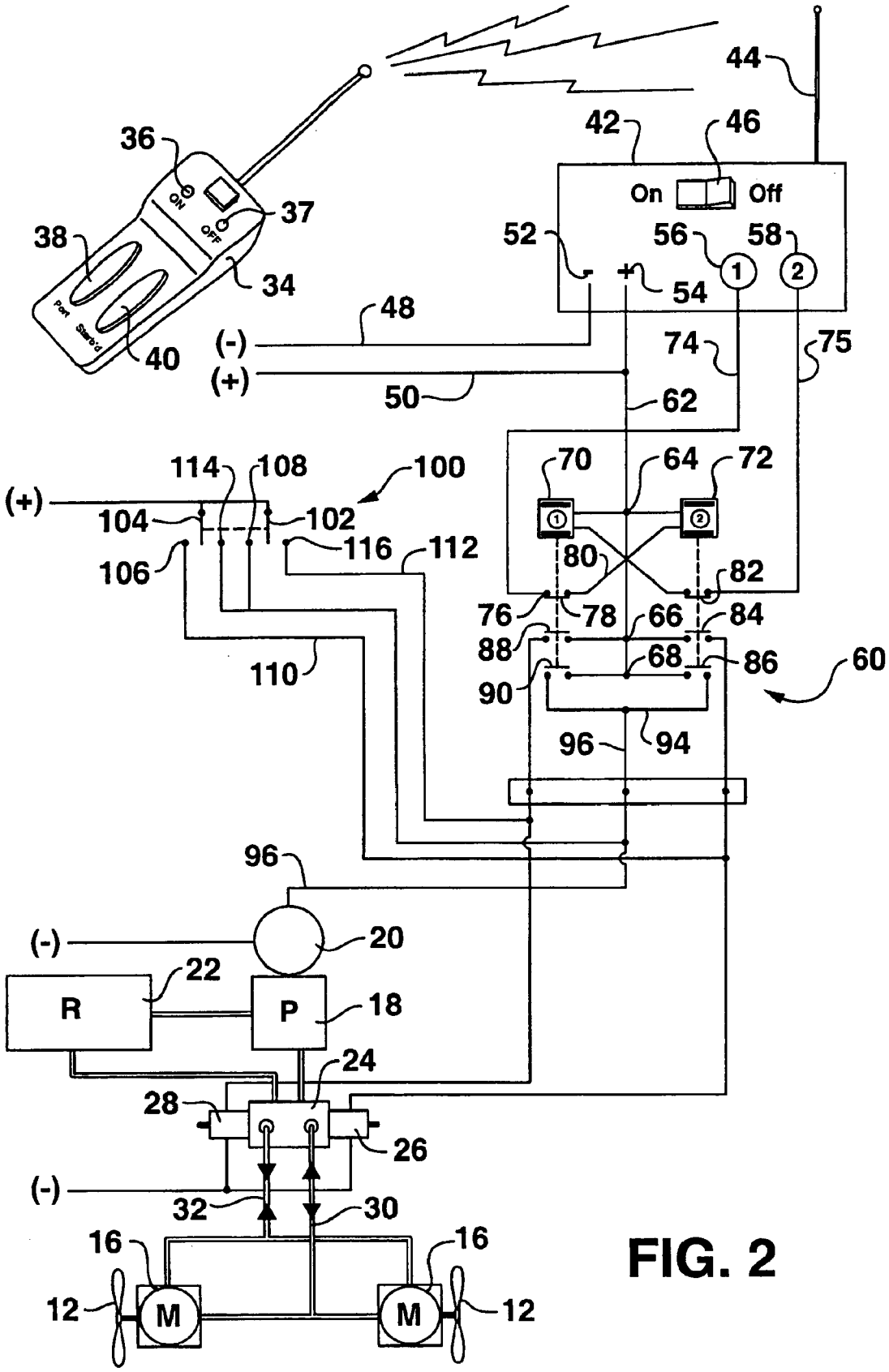
FIG. 2 is a schematic diagram illustrating the controls for the thrusters provided on the boat.

FIG. 2 illustrates schematically a thruster 12 that can be mounted on the boat for producing a force perpendicular to the longitudinal length of the boat when energized. The thruster is driven by hydraulic motors 16 that received pressurized hydraulic fluid from a hydraulic pump 18. A clutch 20 is associated with the pump so that upon being engaged, it causes the pump 18 to pump pressurized hydraulic fluid from a reservoir 22 through a solenoid valve 24 that controls the flow of hydraulic fluid to the thruster motor 16. The solenoid valve 24 is provided with a first and second solenoid 26 and 28 respectively. When solenoid 26 is energized, it allows hydraulic fluid to flow through the hydraulic pump 24 and hydraulic line 30 to the hydraulic motor 16 for rotating the thruster in one direction. This causes a thrust force to be applied to the stern of the boat in a first direction.

When the solenoid 28 is energized, it in turn causes the solenoid valve 24 to permit hydraulic fluid to flow through line 32 to the hydraulic motors 16 of the thrusters 12 to rotate the thrusters in the opposite direction.

As a result, the direction that the motors 12 of the thrusters are rotating depends upon which of the solenoids 26 and 28 are energized. While there are shown to be two hydraulic motors 16 for driving the thrusters 12, it is to be understood that a single motor could be utilized and the propellers arranged on an output shaft of the motor so that they would drive the water into the same direction.

In other words, if two motors are used, they work in conjunction to move water in one direction whereas the same occurs if a single motor is used and two propellers are mounted on the output shaft of the motor in different configurations so that the water will be moved through the thruster in the same direction. The hydraulics and controls so far described are convention for thrusters used on boats.

A remote radio frequency transmitter 34 is provided for generating RF signals for controlling the operation of the thrusters on the boat. The radio frequency transmitter can be any suitable conventional radio frequency transmitter. The transmitter is normally provided with an "on" button 36 and an "off" button 37. It is also provided with a first control button 38, which upon being depressed causes the thrusters to apply a force to the port side of the boat, and when the button 40 is depressed, the thrusters are energized to apply a force to the starboard side. It is to be understood that any suitable conventional thruster could be utilized.

A radio frequency receiver 42 is provided for receiving by means of an antenna 44 the RF signals being transmitted by the radio frequency transmitter 34. The receiver has an on/off button 46 that is used for engaging the system when desired. The receiver 42 is connected to a source of power indicated by positive and negative symbols through lead lines 48 and 50 to the terminals 52 and 54 respectively.

The receiver also has output terminals 56 and 58 that are activated by the RF signal to provide a controlled signal that is sent through a switching circuit to control the energization of the solenoids 26 and 28 associated with the solenoid valve 24. Depending of which of the buttons 38 or 40 of the remote transmitter is depressed, one of the terminals 56 or 58 will be energized. An electric switching circuit 60 is interposed between the receiver 42 and the controls for the hydraulic motors 16 of thruster 12.

The electric circuit 60 includes a main positive power buss 62 that is connected to the positive terminal 54 on the receiver. The buss 62 extends through the switching circuit to a first junction 64, a second junction 66, and third junction 68. The buss 62 has leads extending therefrom to switch contacts forming part of relay control circuits 70 and 72.

Leads 74 and 75 extend from the terminals 56 and 58 of the receiver 42 to the electric switch circuit 60 that includes the relays 70 and 72. For example, lead 74 extends from terminal 56 to one contact 76 of a switch 78 that is controlled by the relay 70. The other terminal of switch 78 is connected by a jumper line 80 to relay 72. Current flows through the relay 72 back to junction 64 for completing the circuit. When such occurs, relay 72 is energized. Associated with relay 72 are switches 82, 84, and 86. As shown, switch 82 is normally closed, and switches 84 and 86 are normally open. Associated with relay 70 are switches 78, 88, and 90. Relay switch 76 is normally closed, and relay switches 88 and 90 are normally open.

Going back to relay 72 as being energized when there is a signal at terminal 56 of the receiver, such causes the relay contact 82 to be open. This prevents energization of relay 70. It also closes switches 84 and 86. When switch 84 is closed, a positive voltage is applied through line 62, switch 84 to solenoid 26 to energize solenoid 26 of solenoid valve 24. This permits fluid to flow through the solenoid valve 24 to the hydraulic motors 16. Also when relay 72 is energized, switch 86 is closed. When switch 86 is closed, a positive voltage is connected through lead 96 to energize the clutch 20 associated with the pump 18 to cause the pump to pump hydraulic fluid through the solenoid valve to the motor 16.

The operation of relay 70 and its associated switches is identical to that of 72 with the exception that when relay 70 is energized, the solenoid 28 is energized to allow fluid to flow through the solenoid valve to the motors 16 for driving the thruster motors in the opposite direction.

When a signal is applied to terminal 58 of the receiver, this signal is transmitted over line 75 through switch contact 82 to energize relay 70. When relay 70 is energized, the normally closed relay switch 78 is opened preventing relay 72 from being energized. The energization of relay 70 also causes switch contacts 88 and 90 to be closed. When switch contact 90 is closed, such causes the clutch 20 associated with the pump to be energized. When switch contact 88 is closed, a positive voltage is applied through switch contact 88 to solenoid 28 for energizing solenoid 28. As previously stated, when solenoid 28 is energized, it allows hydraulic fluid to flow through the solenoid valve 24 to the hydraulic motor 16 of the thruster 12 for reversing the direction of the thrusters.

The hydraulic thruster 12 is a conventional thruster, and in normal use it is operated through a joystick generally designated by the reference character 100. The joystick is mounted on the bridge of the boat, and through manipulation the thrusters 12 can be operated in the same manner as discussed above in connection with the operation of the remote transmitter 34.

The joystick includes moveable terminals 102 and 104. When the joystick is moved to the left, terminals 104 and 102 engage contacts 106 and 108 respectively applying a positive voltage over leads 110 and 112.

Such causes solenoid 26 to be energized and also the clutch 20 associated with the pump to be energized. When the joystick is moved to the right, contact is made between contacts 104 and terminals 114 and 116. When this occurs, a positive voltage is applied to energize solenoid 28 of the solenoid valve 24.

When an operator of a boat is traveling along a desired course, or traveling on a body of water, and the boat deviates from its desired course, the operator through manipulation of the remote transmitter, can energize the thrusters on the boat to bring the boat back to its desired course of travel. The operator can also during docking of boat, walk around the deck of the boat, and with the remote control in his hand, manipulate the thrusters to dock the boat. While the apparatus has been shown as being mounted on a houseboat, it is to be understood that such can also be used in trawlers and other boats of various configurations.

Figure 3:
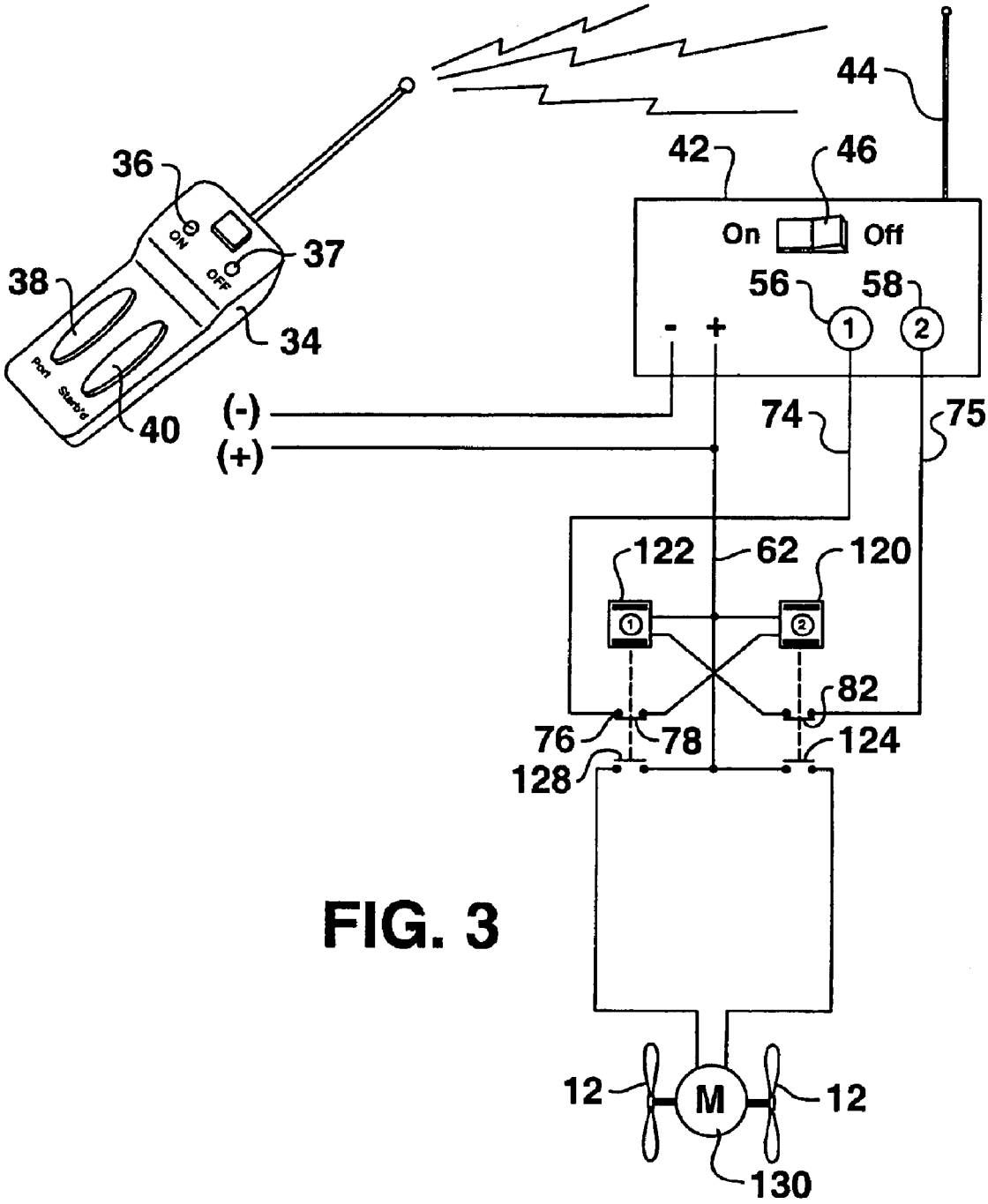
FIG. 3 is a schematic diagram of a modified form of the controls for the thrusters.

While the above description has been made in reference to utilizing a thruster operated by a hydraulic motor, it is to be understood that the thrusters can be manipulated by an electric motor that is adapted to be driven in either a clockwise or counterclockwise direction depending on the polarity of the signals being supplied to the motor. For example, as shown in FIG. 3, the relays 120 and 122 are selectively provided for opening and closing switches 124 and 128 upon receiving signals on the terminals 58 and 56 of the receiver 42. When the relay 120 is energized, the terminal 124 is closed allowing a positive voltage to be applied through the switch 124 to one side of an electric motor 130. Such causes the thruster to rotate in one direction. The electric motor is equipped with propellers in the same manner as the hydraulic motor of FIG. 2.

However, upon receiving a different signal from the remote transmitter 34 and receiver 42, the relay 122 is energized closing contact 128 allowing a positive voltage to be applied to the other side of the motor 130 for driving the motor in the opposite direction from that as occurred when relay 120 was energized. Relays 120 and 122 are wired in the same manner as shown in FIG. 2 and as a result the description will not be repeated.

It is also understood that instead of using a reversible electric motor, an electric transmission under control of the signals from relays 120 and 122 can be used with an electric motor for selectively driving propellers in two directions.

While the thrusters 12 have been shown at the stern of the houseboat, it is to be understood that the thrusters could be mounted at different locations on the boat such as the front or rear of the boat if desired. It is also understood that while the remote control for these thrusters can be used while the boat is under power for making corrections to the direction of travel of the boat, it can also be used in docking the boat. As a result of the controls for the thrusters being a remote transmitter, the operator of the boat can move around the boat, and oftentimes be on the deck on the boat during the docking operation.

While a preferred embodiment of the invention has been described above, it is understood that any all equivalent realizations of the present invention are included within the scope and spirit thereof. Thus, the embodiments depicted are presented by way of an example only and are not intended as limitations upon the present invention. While particular embodiments of the invention have been described and shown, it would be understood by those of ordinary skill in the art that the present invention is limited thereto since many modifications can be made. Therefore, it is contemplated that any and all such embodiments are included in the present invention as may fall within the literal or equivalent scope of the appended claims.

What is claimed is:

1. An apparatus for aiding in steering and maneuvering a boat having a hull and equipped with an engine for propelling said boat through water comprising:

a thruster carried by the hull of said boat for selectively supplying a driving force in substantially a first direction or a second direction perpendicular to a longitudinal axis of said boat;

said thruster including an electric motor;

an output shaft carried by said motor;

said electric motor being fixed to said hull, and said output shaft extending substantially perpendicular to said longitudinal axis of said boat;

a propeller carried by said output shaft for being selectively rotated in a clockwise or counterclockwise direction by said motor;

a source of power for energizing said motor;

an electric circuit connecting said source of power to said motor for selectively energizing said motor for rotating said motor in a clockwise or counterclockwise direction;

a remote radio frequency transmitter;

a radio frequency receiver carried on said boat and electrically connected to said electric control circuit; and switching members carried by said radio frequency transmitter for selectively transmitting radio frequency signals to said radio frequency receiver causing said electric circuit to energize said motor of said thruster to produce a driving force in a first or second direction substantially perpendicular to a longitudinal axis of said boat for imparting a moving force to said boat.

2. The apparatus as set forth in claim 1 wherein said electric circuit includes a relay circuit and at least two switches wherein when said source of power is connected through one of said two switches to said electric motor said output shaft of said motor is rotated in one direction and when said source of power is connected through said other of said two switches said output shaft of said motor is rotated in the opposite direction.

3. The apparatus as set forth in claim 2 wherein said relay circuit includes a pair of relays for selectively closing said two switches responsive to said transmitted radio frequency signals.

* * * * *